United States Patent [19]

Budin et al.

[11] Patent Number: 4,884,187

[45] Date of Patent: Nov. 28, 1989

[54] VOLTAGE REGULATOR WITH FERROMAGNETIC FILTER

[75] Inventors: Maurice Budin, Bron; Pierre Veyrand, Saint Priest, both of France

[73] Assignee: Automatismes Energie Electronique Systemes, France

[21] Appl. No.: 280,002

[22] Filed: Dec. 5, 1988

[30] Foreign Application Priority Data

Dec. 8, 1987 [FR] France ..... 87 17369

[51] Int. Cl.[4] ..... G05F 1/13

[52] U.S. Cl. ..... 363/141; 361/384

[58] Field of Search ..... 363/75, 82, 90, 91, 363/141; 361/380–384; 336/55, 59–61

[56] References Cited

U.S. PATENT DOCUMENTS

| | | | |
|---|---|---|---|
| 2,424,344 | 7/1947 | Veinott | 363/141 |
| 2,679,024 | 5/1954 | Oestreicher | 363/141 |
| 3,790,860 | 2/1974 | Verdisco | 363/141 |
| 3,819,965 | 6/1974 | Schoendube | 310/58 |
| 4,032,873 | 6/1977 | Jallouk | 336/57 |
| 4,035,711 | 7/1977 | Piller | 363/141 |
| 4,327,398 | 4/1982 | Christison | 361/384 |
| 4,665,466 | 5/1987 | Green | 361/384 |

FOREIGN PATENT DOCUMENTS 2417415 5/1975 Fed. Rep. of Germany .

*Primary Examiner*—Peter S. Wong
*Attorney, Agent, or Firm*—Wall and Roehrig

[57] ABSTRACT

A ferromagnetic voltage regulator has the saturatable core reactor and electromagnetic winding closely coupled with a fan mounted in a housing on one surface to cool the assembly by forcing air through the windings and over the other surfaces of the regulator.

3 Claims, 1 Drawing Sheet

VOLTAGE REGULATOR WITH FERROMAGNETIC FILTER

BACKGROUND OF THE INVENTION

The present invention relates to an improvement in ferromagnetic voltage regulators using the properties of ferromagnetic resonance for saturating magnetic circuits, which are used, in particular, in inverters as well as in voltage-stabilizing regulators, and for which the ferromagnetic properties with saturation of the magnetic circuit are used in the voltage regulating process.

In general, such regulators are essentially constituted of a magnetic circuit associated to windings.

The regulators found heretofore on the market are satisfactory but only from a functional point of view, as indeed, for a given power and given performances, they lead to heavy and bulky (hence costly) assemblies, due to the evacuation of the thermal losses released by the magnetic circuit as well as by the various windings which, heretofore, has been performed simply by controlling the temperature of the ambient air surrounding the device, the thermal exchange being achieved by simple natural conduction and convection.

In other applications, such as for example in the field of transformers or voltage regulators, it has been proposed for a very long time to incorporate thereto cooling systems permitting the evacuation of thermal losses. One of the proposed solutions, is described in DOS. 2 417 175 which makes use of a flow of fluid inside a voltage regulator, and others in U.S. Pat. Nos. 3,819,965 and 4,032,389 relating to voltage transformers and regulators, in which cooling is achieved by means of a flow of fluid channelled inside well-defined circuits. The cooling systems used in all the aforesaid solutions, are complex and imply adapting the components of the apparatuses.

SUMMARY OF THE INVENTION

It has now been found, and this is precisely the object of the present invention, that it is possible, in the case of voltage regulators with ferro-resonant filters, not only to ensure the evacuation of thermal losses, but also to produce regulators of considerably reduced dimensions in view of the conventional ones, and this for a substantially identical power and performance, by associating to said regulator an assembly permitting the forced extraction of thermal losses released by the magnetic circuit as well as by the various windings, said extraction being performed by acting on most of the surface of the different components of the regulator, said latter not being in any way modified compared with the prior solutions.

According to the invention, the assembly permitting the extraction of the thermal losses is simply constituted by a forced air flow, directed against one of the surfaces of the regulator and flowing along the other surfaces.

BRIEF DESCRIPTION OF THE INVENTION

The invention will be more readily understood on reading the following description given with reference to the accompanying drawing in which the one and only FIGURE illustrates diagrammatically and in perspective, one example of embodiment of a regulator according to the invention.

DETAILED DESCRIPTION OF EMBODIMENT

Figure 1:
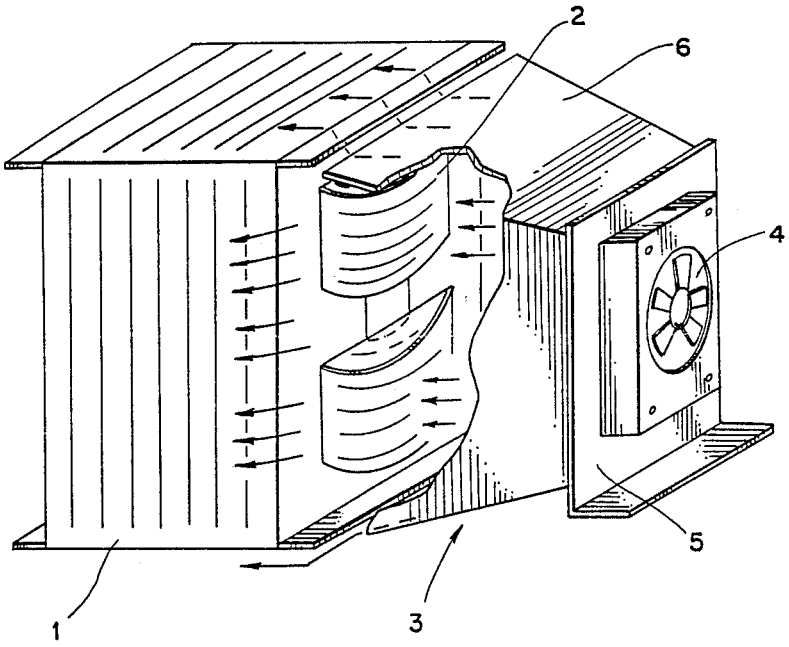

Referring to said drawing, this shows that the actual regulator is conventionally constituted, of a ferromagnetic circuit (1) associated to windings (2). According to the invention, on one of the sides of the regulator, for example on the side of the surface carrying the winding (2), there is provided an assembly for extracting the thermal losses released by the magnetic circuit (1) as well as by the windings (2), said assembly being designated by the general reference (3) and being essentially constituted of a fan (4) placed in facing relationship to the windings (2). Said fan (4) is mounted on a support (5) and its air flow is channelled, for example by means of a casing (6), which extends from the support (5) to near the windings, and this in such a way that the air flow covers the whole surface of the regulator. The air flow escapes, on the one hand, through the windings, and on the other hand, and particularly, sideways along the walls of the regulator. Obviously, the air flow rate will depend on the power of the regulator, hence of the thermal losses occurring, and will be adjusted to extract nearly most of said losses, despite very limited heating of the system both on the peripheral surface and inside the magnetic core and winding.

It has been found that it is possible, by proceeding as indicated above, not only to cool the whole assembly, but also to obtain a reduced dimensioning of the regulator, and this for a substantially identical power and losses. By way of illustration, it has been possible to produce a 5 KVA regulator, weighing about 60 kg and of 25 dm3 overall volume, whereas until now, the weight of an equivalent regulator having a capacity of 5 KVA and of which the thermal losses are evacuated solely by controlling the temperature of the ambient air, just by natural conduction and convection, was actually 50 kg for an overall volume of 70 dm3. Such a reduction of the dimensions of the regulator components may be explained by the fact that the adjunction of all the extractions of released thermal losses, makes it possible to increase considerably the joules losses/iron losses ratio, and this without any noticeable changes in the overall losses and in the other performances of the regulator.

The invention is in no way limited to the example of embodiment described hereinabove and on the contrary covers any variant thereof made within the same spirit.

For example, for very high powered regulators, it would be possible to use other systems for extracting joules losses than the forced air flow system, such as using a cooling fluid system or any other system combination (water flow, fingers or dissipators coupled at the level of the magnetic circuit, etc.).

What is claimed is:

1. A ferromagnetic voltage regulator of the type having ferro-resonant saturating magnetic circuits comprising:

a ferromagnetic circuit member;

at least one electromagnetic winding disposed in operative relationship with said circuit member;

forced thermal heat extraction means;

fluid directing means operatively coupling said heat extraction means first to said electromagnetic winding and then to said ferromagnetic circuit member to remove from the regulator the thermal losses of the winding and circuit members and increase the joules losses to iron losses ratio.

2. The ferromagnetic voltage regulator of claim 1 wherein said forced thermal heat extraction means comprises forced air flow means and said fluid directing means comprises air ducts disposed to direct air first on said electromagnetic winding and then along a plurality of the surfaces of said ferromagnetic circuit member.

3. The ferromagnetic voltage regulator of claim 2 wherein said forced air flow and fluid direction means comprise;

a casing member mounted about said electromagnetic winding member, a fan mounted on said casing member to force air through said casing onto said electromagnetic member; and ventilation openings disposed in said casing member adjacent said ferromagnetic circuit member directing a flow of air from said fan over the surfaces of said ferromagnetic circuit member.

* * * * *